US006159548A

United States Patent [19]

Moody

[11] Patent Number: 6,159,548

[45] Date of Patent: Dec. 12, 2000

[54] AFTER-TREATMENT METHOD FOR OIL- AND WATER-REPELLENCY OF FIBROUS SUBSTRATES

[76] Inventor: Richard J. Moody, 4001 Kennett Pike, Suite 134, Wilmington, Del. 19807

[21] Appl. No.: 09/449,163

[22] Filed: Nov. 24, 1999

Related U.S. Application Data

[63] Continuation-in-part of application No. 09/160,019, Sep. 24, 1998, abandoned, which is a continuation-in-part of application No. 09/372,492, Aug. 12, 1999.

[51] Int. Cl.[7] ..... B05D 1/02; B05D 1/18; B05D 3/02

[52] U.S. Cl. ..... 427/389.9; 427/392; 427/393.4; 427/421; 427/430.1

[58] Field of Search ..... 427/389.9, 392, 427/393.4, 421, 430.1

[56] References Cited

U.S. PATENT DOCUMENTS

| | | | |
|---|---|---|---|
| 2,803,615 | 8/1957 | Albrecht et al. | 524/805 |
| 3,628,997 | 12/1971 | Elkind et al. . | |
| 4,439,473 | 3/1984 | Lippman | 428/90 |
| 4,564,561 | 1/1986 | Lore et al. | 428/422 |
| 4,595,518 | 6/1986 | Raynolds et al. . | |
| 5,047,065 | 9/1991 | Vogel et al. | 8/115.6 |
| 5,212,272 | 5/1993 | Sargent et al. | 526/317.1 |
| 5,539,072 | 7/1996 | Wu | 526/304 |
| 5,629,376 | 5/1997 | Sargent et al. | 524/745 |
| 5,670,469 | 9/1997 | Dingus et al. | 510/274 |
| 5,902,637 | 5/1999 | Castellano, Jr. et al. | 427/242 |

FOREIGN PATENT DOCUMENTS

| | | |
|---|---|---|
| 1561678 | 3/1969 | France . |
| 19516907 | 11/1996 | Germany . |
| 62-215074 | 9/1987 | Japan . |
| 7-011241 | 1/1995 | Japan . |

OTHER PUBLICATIONS translation of JP07–011241, Jan. 1995.

McNeil, Text Res. J. 1990, 60(4), pp. 244–245. Abstract.

Technical information and Material Safety Data Sheets for ZONYL® 6991, DuPont Specialty Chemicals, Oct. 3, 1994.

*Primary Examiner*—Erma Cameron

*Attorney, Agent, or Firm*—Connolly Bove Lodge & Hutz LLP

[57] ABSTRACT

A method is provided for after-treating fabric with a fluoroacrylate emulsion by spraying or immersion. The immersion can be carried out in a laundering process (preferably in a late cycle of the process) or even under poorly-controlled conditions (e.g. field conditions). The spraying embodiment of this method is useful for treating large, previously manufactured items comprising fabric (e.g. upholstered furniture, tents, awnings, and the like) with an aerosol spray containing micrometer or submicrometer-sized droplets of a diluted version of the fluoroacrylate emulsion. In all embodiments, the fluoroacrylate emulsion contains, dispersed therein with the aid of a surfactant system, essentially a single hydrophobic component comprising a particulate fluoroacrylate copolymer having repeating units of the formulas I and II (I)

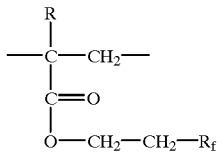

(II)

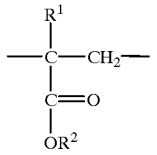

wherein $R_f$ is a $C_8$-rich fluorinated alkyl radical; R and $R^1$ are hydrogen or alkyl; and $R^2$ is hydrogen or substituted or unsubstituted alkyl. The aqueous dispersion further contains, in addition to the surfactant system, a minor amount of polar organic liquid. Depending upon the melting or softening point of the fluoroacrylate copolymer, drying under heat can be optional and in any event can be carried out at temperatures below 100° C.

13 Claims, No Drawings

AFTER-TREATMENT METHOD FOR OIL- AND WATER-REPELLENCY OF FIBROUS SUBSTRATES

CROSS REFERENCE TO RELATED APPLICATIONS

This is a continuation-in-part of my copending application Ser. Nos. 09/160,019, filed Sep. 24, 1998, now abandoned, and Ser. No. 09/372,492, filed Aug. 12, 1999. The disclosures of these copending applications are hereby incorporated by reference for all purposes.

FIELD OF THE INVENTION

This invention relates to the use of a composition for providing a fluorochemical after-treatment to a fully manufactured item comprising fabric. An aspect of this invention relates to fluorochemically-treating a fluid-repellent fibrous material such as a "barrier fabric" to impart, enhance, or restore fluid-repellent (both water- and oil-repellent) properties after the barrier fabric has been subjected to extensive use and/or cleaning. An aspect of this invention relates to fluorochemical after-treatments of fabrics, both pre-treated and non pre-treated, which in normal use come into contact with materials that leave deep stains (food, bodily fluids, etc.) or which are exposed to adverse weather conditions and hence must be washed or dry-cleaned very frequently. Still another aspect of this invention relates to methods for treating fabrics with a fluorochemical in circumstances in which a source of heat is not available or is inconvenient to use.

DESCRIPTION OF THE PRIOR ART

It has long been known that certain fluorochemicals impart both oil- and water-repellency to fabric. The fluorochemical treatment is typically carried out during a manufacturing stage (e.g. in a textile mill), but most fluorochemical treatments are subject to loss of efficacy due to dry cleaning, laundering, or use. The efficacy of the original fluorochemical treatment can be restored, at least in part, by after-treatments. Such after-treatments can also be used to treat fully-manufactured fabric items which have never been given a fluid-repellent treatment. But because of concerns regarding effects of volatile organic solvents or diluents on the environment, aqueous dispersions of fluoropolymers (which contain at most only minor amounts of organic liquids) have come into widespread use for such after-treatments. Typically, the aqueous (as opposed to solvent-based) after-treatments require a "curing" step, generally a heat treatment. In many cases these heat treatments require heating the fluid repellent-treated material to a temperature of at least about 80° C., in some cases up to as high as 150° C. or more, depending upon, for example, the particle size of the dispersed fluoropolymer, the surfactant system used to keep the fluorochemical particles dispersed (and to assist in exhausting the fluoropolymer onto the fabric being treated), and, perhaps most important, the melting or softening behavior of the fluoropolymer under mildly elevated temperature conditions. Commonly available clothes dryers for home use can provide drying temperatures up to almost 75° C., but special, e.g. commercial laundry, dryers are needed for hotter drying environments.

Fluorochemicals such as fluoroacrylate or fluoroacrylic polymers provide oil-repellent or oil-barrier (oleophobic) properties at low levels of application and water-repellant or water-barrier (hydrophobic) properties at somewhat higher levels of application. Aqueous fluoroacrylate polymer dispersions have been developed for both pre- and after-treatments, but, due to the high melting points of some of the fluoroacrylate polymers, mill treatments are often preferred. It is of great importance to increase the efficiency of both pre- and after-treatments, since fluoropolymers are expensive compared to non-fluorinated polymers. Accordingly, low loadings or low application rates of fluoropolymer are preferred in this art, but the water-repellent properties of the resulting fibrous substrates can then be weaker than the oil-repellent properties. To increase the efficiency of low loadings or low application rates of the fluoropolymer, particularly with respect to water-repellency, non-fluorinated, polymeric or wax-like "extenders" can be used, which are less expensive than fluorochemicals.

"Extender" is a term of art for a non-fluorinated substance, used in combination with the fluorochemical, that has water-repellent (but generally not oil-repellent) properties of its own and is typically a low-melting, substantially water-insoluble material such as a mineral wax or a synthetic organic polymeric material such as a low molecular weight polyethylene, fluorine-free acrylic polymers (including polyacrylates, polymethacrylates, and polyacrylonitriles), a polysiloxane, or other relatively hydrophobic polymers that are generally available in latex form, such as poly-diene homopolymers and heteropolymers.

Not long after the development of suitable fluid-repellent pre-treatments, i.e. treatments for mill or manufacturing operations, it was found that the fluid-repellent treatment weakens significantly with time, due to use or cleaning (e.g. laundering) of the manufactured fibrous item. It was also found that fluorochemical after-treatments could ameliorate the adverse effects of repeated laundering upon the fluorochemical pre-treatments. Fluorochemical-containing compositions were formulated for after-treatment purposes, i.e. to restore the fluid-barrier or fluid-repellent (hydrophobic and/or oleophobic) properties of the pre-treated material. An example of such a composition is ZONYL® 6691, an aqeuous fluorochemical dispersion, developed by E.I. du Pont de Nemours & Co. of Wilmington, Del., U.S.A., which has a hydrocarbon wax "extender" and is intended for use in, inter alia, a cycle of a laudering machine. And, in late 1994, a similar fluorochemical dispersion product was developed which contained a fluoroacrylate polymer, a cationic surfactant, and a paraffin wax extender, all dispersed or emulsified in an aqueous medium (PROTEX 2000-B™ fluid repellent, a product of M&M Technologies, Inc.). This fluid-repellent product was very efficient in pre- or after-treatments but posed the same problems as other extender-containing products.

Although extenders provide increased water-repellency at relatively low cost, fabrics treated with these extenders can have increased flammability and decreased breathability when compared to fabrics treated with a fluorochemical only. Etenders can interfere with the smooth, trouble-free operation of laundering or drying equipment, and the extender component in a aqueous-dispersion product can interfere with product stability in storage or transportation, e.g. by lessening or virtually eliminating the freeze-thaw stability of the product as a whole or by breaking from their own emulsified state under normal ambient conditions. The interference with operation of laundering equipment typically occurs when an extender such as a hydrocarbon wax can begin to melt or soften at temperatures as low as about 45° C.; such extenders can resolidify in places such as the outside of a washer or dryer drum, the inside of delivery lines and liquid injection systems in commercial laundries, and other functionally crucial and/or difficult-to-service areas of washing or drying equipment.

On the other hand, if the extender is eliminated, other complications can arise besides the increased need for high fluorochemical loadings and hence increased costs. Some fluoropolymers have a high crystallinity content and do not melt at temperatures below 90 or 100° C., making them impractical for use in after-treatments in which no convenient heat source is available or in which the available heat source (e.g. a conventional clothes dryer) does not provide a hot enough environment for the fluorochemical to become fully effective.

Single fluoroacrylate polymers and complex fluoropolymer mixtures have been developed which, in aqueous dispersion form, can be applied to a fabric and then air dried and/or cured. Typically, these aqueous dispersions contain fluoroacrylate polymers of small particle size and low softening points or melting points. In addition, the polymer and/or the surfactant system can be designed to facilitate more lasting deposition on the fabric under mild conditions.

Fluorochemical treatments which "cure" under normal ambient conditions (e.g. air drying at room temperature) have special importance for after-treatments under circumstances in which a convenient source of heat is not readily available. An example of such an after-treatment is the restoration or enhancement of the properties of non-waterproofed or previously waterproofed garments, blankets, tents, awnings, upholstery, and various fabric items which must be treated in place or under field conditions (e.g. during military operations), where the only laundering facilities available may be an essentially stationary or temporary wash tank such as a large drum filled with wash water and fluorochemical treatment medium in which the item can be immersed—provided that the item is small enough. Clothes-drying capabilities in these situations may amount to nothing more than a clothesline and/or a portable hair dryer. Awnings, tents, upholstered furniture, and other fully fabricated items too large for immersion would normally have to be sprayed with a portable sprayer, and the ambient temperature may not be warm enough for a good cure.

To satisfy these needs, fluorochemical treatments should preferably be improved in hydrophobicity so as to be efficient for water- as well as oil-repellency at relatively low levels (thereby avoiding the need for extenders), especially in the case of after-treatments of frequently-cleaned, easily-stained garments or protective gear, table cloths, or curtains, such as culinary, military, and healthcare or laboratory garments, aprons, drapes, or similar protective clothing or gear.

To be fully effective when a good heat source is unavailable (e.g. temperatures below 55° C. or even to normal ambient temperatures, as in the case of spray-treating an item which cannot be placed in a clothes dryer), a fluorochemical treatment ought to be very rugged; that is, the treatment is preferably insensitive to adverse or uncontrolled conditions (e.g. uncontrolled pH in the wash water and uncontrolled ambient temperature or humidity). Textile mill treatments, where conditions can be controlled with considerable precision, can be far more sensitive to the treatment conditions and still be effective.

The patent literature relating to fluorochemical treatments of fibrous substrates has become fairly extensive since fluoropolymers specifically for this purpose were developed in the 1950's. Illustrative references include the following U.S. Pat. No. 4,564,561 (Lore et al), issued Jan. 14, 1986, U.S. Pat. No. 4,595,518 (Raynolds et al), issued Jun. 17, 1986, U.S. Pat. No. 4,439,473 (Lippman), issued Mar. 27, 1984, U.S. Pat. No. 5,212,272 and U.S. Pat. No. 5,629,376 (Sargent), issued May 18, 1993 and May 13, 1997, respectively, and U.S. Pat. No. 5,539,072 (Wu), issued Jul. 23, 1996.

SUMMARY OF THE INVENTION

In seeking to reach the goals of this invention, it has been discovered that:

First, greater efficiency in fluoroacrylic polymer treatments can be obtained when the pendent fluorocarbon groups of the polymer have a very low or negligible $C_{<6}$, $C_6$, $C_{10}$, $C_{12}$, and $C_{>12}$ content. The fluoroacrylic polymer is therefore extremely rich in pendent $C_8$-fluorocarbon groups, and the major amount of these fluorocarbon groups have $C_8$-chains that are preferably linear.

Second, the fluoroacrylic polymer treatment can be "curable" at temperatures below 100°, preferably below 90°, and, particularly in the case of sprayed after-treatments and in-the-field treatments, below 55° C. To obtain the best low temperature cures, it is important that the fluoroacrylic polymer have a softening—or, more typically, a melting—point below 100° C., preferably below 90° C, most preferably in the range of about 20 to about 800 C. For after-treatments which are carried out in a laundering zone and include a "curing" (heat-treatment) step at temperatures within the heating capabilities of conventional, home-use clothes dryers, a fluoropolymer melting point range of 45 to 90° C. is desirable, and for after-treatments where no heat source is available, the melting point is preferably in the range of 20 to 55° C.

Third, it is desirable that the fluoroacrylic polymer be essentially free of sulfur-containing, especially —$SO_2$-containing (e.g. sulfonamido, sulfate, sulfonyl) groups, and urethane linkages. Strictly speaking, a "urethane" linkage is generally considered to be —NH—CO—O—, but in this art the term "urethane" includes other urethane-like groups derived from the reaction of active hydrogen with an isocyanate compound (e.g. —NH—CO—NH—, thiourethanes, etc.).

Fluoroacrylate dispersions which meet the foregoing criteria can provide treatments that are surprisingly effective with economically feasible loadings of the dispersion on the fibrous material while eliminating or substantially eliminating the use of non-fluorinated polymeric or wax-like extenders.

Moreover, when the melting point of the fluoroacrylate polymer is low enough (preferably below 55° C.), dispersions of the polymer can be applied successfully under conditions which are not so economically sensitive, hence higher loadings of fluoroacrylate are practical.

It has also been found that, when the melting point of the dispersed fluoropolymer is below 55° C., substantially the same aqueous fluoroacrylate after-treatment technology can be applied as an aerosol spray capable of air-drying on large manufactured items comprising fabric—items that are too bulky to be immersed in a wash tank. Typically, these items have also been pre-treated with a fluorochemical, but the spray-application embodiment of this invention can also be employed to provide an initial waterproofing and oil-repellent treatment if the manufacturer did not apply any fluorochemical.

Thus, one embodiment of the invention is a method involving the following steps:

A. In a laundering process carried out in a laundering zone (e.g. the wash tank of a washing machine) containing a load of fibrous substrate material, introducing into the laundering zone, during a cycle of the laundering process, an aqueous medium that is essentially free of extenders and contains a surfactant component and a dispersed fluoroacrylate polymer component in which the fluoroacrylate polymer is essentially free of —$SO_2$— groups and urethane groups, which has a melting or softening point lower than 100° C. and which has pendent fluorocarbon chains (preferably linear chains) which have a major amount of $C_8$ content, and B. In a drying zone (e.g. the rotatable drum of a clothes dryer), heat-treating the previously laundered fibrous substrate material at a drying zone temperature above 45° C. but below 100° C.

A second embodiment of the invention is a method involving the following steps:

A. Applying to a fabric-containing item a fabric-treating aqueous dispersion containing, dispersed therein, a particulate fluoroacrylate copolymer having repeating units of the formula:

(I)

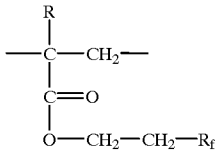

and (II)

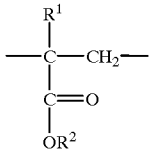

wherein $R_f$ is a fluorinated alkyl radical having 6, 8, 10, and/or 12 carbon atoms, the major amount (in moles or by weight) of $R_f$ radicals having 8 carbon atoms and being preferably linear, the amount of each of the $C_6$, $C_{10}$, and $C_{12}$ chains being <about 20% on a weight basis;

R is hydrogen or a $C_1$–$C_4$-alkyl radical;

$R^1$ is the same as or different from R but is also hydrogen or a $C_1$–$C_4$-alkyl radical, and $R^2$ is hydrogen or a $C_1$–$C_4$-alkyl radical which is unsubstituted or substituted, e.g. substituted by hydroxyl, $C_1$–$C_4$-alkoxy, or an amino group.

In addition to the above-described fluoroacrylate copolymer, the aqueous dispersion also contains a minor amount of a multi-purpose surfactant system (this system assures a fine, stable dispersion of the copolymer and also assists in depositing the copolymer on the fabric). The surfactant system preferably contains at least one amphoteric surfactant and preferably also a nonionic surfactant. A cationic surfactant can also be present. The aqueous dispersion further contains a minor amount of polar organic liquid dissolved in the aqueous medium. It is preferred that the degree of linearity, the weight-average molecular weight ($M_w$), and the number-average molecular weight ($M_n$) of the fluoroacrylate polymer be selected so that the softening or melting point of the polymer (typically the polymer is sufficiently crystalline to have a meaningful melting point) is not significantly greater than 100° C. and is preferably below that temperature. The melting or softening point of the above-described fluoroacrylate polymer, broadly speaking, can range from 20 to 90° C., but for this second embodiment the melting or softening point ranges from 20 to 55° C.

B. Drying the thus-treated fabric-containing item at a temperature below 55° C., e.g. under normal ambient conditions (such as 20 to 30° C./normal atmospheric pressure), until water-repellent properties have been imparted or enhanced. No further drying is needed to obtain or preserve this result. Heating to temperatures about 55° C. does not appear to provide significant further improvement in waterproofing or oil-repellent properties.

According to one aspect of this second embodiment, a manufactured item comprising fabric (e.g. upholstered furniture) which is too large to be immersed in a wash tank is sprayed with a portable sprayer and permitted to dry or cure under normal ambient conditions The portable spray device is preferably provided with a small orifice (e.g. 0.05 to 0.5 mm in diameter) and a source of gas pressure to break up the spray into tiny dispersoid (micrometer- or submicrometer-sized) droplets which form an aerosol. The sprayer dispenses an aqueous dispersion of the type described above. The aqueous dispersion is typically not dispensed in full strength and can be effective after being substantially diluted.

A typical aqueous dispersion useful in the method of this invention (prior to any dilution) consists essentially of:

a. 50 to 90% by weight of a continuous aqueous phase, b. 1 to 10% (preferably 2 to 10%) by weight of a polar organic liquid (e.g. a protic solvent such as a diol) dissolved in the aqueous phase, c. dispersed in the aqueous phase as the dispersed ("oil-in-water") phase, 5 to 40% by weight of the fluoroacrylate polymer component, and d. the surfactant component.

The methods of this invention impart, restore, or enhance oil-repellent properties without sacrificing the restoration or enhancement of water-repellent properties.

DETAILED DESCRIPTION

As will be apparent from the foregoing discussion of the prior art, the skilled artisan can choose from a wide variety of well-controlled waterproofing and/or oil-repellent treatments in the context of fabric manufacturing. The equipment in a textile mill can include pad baths and other baths suitable for either continuous or batch application, high-pressure spray devices or spray devices which produce a coarse spray pattern, and various devices for applying controlled amounts of heat or other controlled radiant energy, not to mention a broad choice of fluorochemicals. Even solvent-based fluorochemicals can be used if the mill has an adequate solvent recovery system.

But once a fabric item has left the mill and has been put to use, the options become very limited. The method of application, for example, can oftentimes be limited to immersion in a wash tank or to spraying with a portable spray device. The available heat source can be limited to providing temperatures not much above 70 or 80° C. And under field conditions, heat curing can be cumbersome at best and totally impractical at worst. For an effective spray pattern, an aerosol (micrometer- or submicrometer-sized droplets dispersed in air) can be needed. Typical portable aerosol sprayers apply rather limited amounts of pressure (provided by compressed air or a compressed propellent), e.g. not more than 70 or 75 p.s.i.g. (≦500 KPa), more typically 10 to 40 p.s.i.g. (70 to 280 KPa). The treatment chemical should be in the form of an aqueous dispersion, Ig although minor amounts of organic solvents or diluents in the dispersion can certainly be tolerated. And, although this invention is not bound by any theory, it is believed that the aqueous dispersion ought to be as simple as possible, hence a narrow distribution range of perfluorinated chains and elimination or substantial elimination of extenders are important for these reasons also.

In the laundering embodiment of this invention, the use of a pH-adjusting agent (e.g. a carboxylic acid to adjust the pH downward) is ordinarily preferred.

Although this invention is not bound by any theory, it is presently believed that the selection of the fluoroacrylic polymer (fluoroacrylate) is of major importance and should meet certain criteria mentioned previously—with respect to all embodiments of this invention. Thus, the fluoroacrylic polymer preferably has a melting point rather than a softening point, and the melting point is below 100° C. (preferably below 90° C.) for the modest heat "cures" conducted in accordance with this invention. (For ambient temperature "cures", the melting point should generally be below 55° C., preferably 20 to 40° C.). The selection of a fluoroacrylic polymer with a well-focused distribution of the relatively short ($C_8$-rich), generally linear pendent fluorocarbon side chains which occur all along the length of the polymer has also been mentioned; the minimal occurrence or total lack of urethane and —$SO_2$— groups has also been mentioned.

With regard to the desired simplicity of fluoroacrylic polymer dispersions, it is theorized that better results can be obtained when all of the desired polymer properties are built into a single fluoropolymer structure via copolymerization (if necessary, the copolymer structure can be a terpolymer, quaterpolymer, etc.). Prior art mill treatments can utilize complex treatment media which can contain as many as three or four different polymers, pre-dispersed in water and then combined to form a single aqueous medium. These complex fluorochemical systems are not suitable for use in this invention.

Thus, the above-described repeating units of the formula II—as well as those of formula I—play a role in the properties of the fluoroacrylate. For example, the hydrophobe/hydrophile balance of the fluoroacrylate can be modified in the direction of better compatibility with water by copolymerizing the fluorinated monomer (compound III, described below) with a monomer mixture containing at least some 2-hydroxyethylmethacrylate or 2-hydroxyethylacrylate. Polyelectrolyte properties can be introduced by including some acrylic acid in the monomer mixture. Cationic sites on the polymer chain can be provided with tertiary amine-substituted acrylic monomers, and so forth.

To illustrate a reason why simplicity of the dispersed phase is preferred, under field conditions there is, at best, poor control over the quality of the water used to dilute the treatment medium and wash the fabric item. Uncontrolled variations in the pH of the water may interfere with the performance of a complex mixture that includes, for example, amphoteric polymers which can become ineffective as treatment agents if the pH is too high or too low. (Amphoteric surfactants are permissible in this invention, however.)

Present experience with this invention indicates that a modest amount of the aqueous dispersion selected according to this invention, when combined with a relatively large amount of wash water, can be deposited on the fiber of the fabric in a sufficient amount to provide needed levels of fluid-repellency or to restore substantially the manufacturer's factory treatment for oleophobic and/or hydrophobic properties. This experience indicates further that an aerosol sprayer applying an appropriate concentration of the aqueous dispersion can deliver enough fluoroacrylate polymer to a fabric so that, after drying under normal ambient conditions, the treated fabric has significantly enhanced oleophobic and/or hydrophobic properties. The performance of the aerosol spray embodiment of this invention compares well with methods which require curing at temperatures as high as 60 to 75° C. or even higher.

The Aqueous Dispersion

The aqueous dispersion selected for use in this invention contains a fluoroacrylate polymer that has been selected in accordance with the principles of this invention ($C_8$-rich fluorocarbon groups, melting points <100° C., essentially free of urethane radicals and sulfonamide, sulfonyl, and sulfate groups). However, if cationic sites on the fluoroacrylate polymer are desired, amino nitrogens can be introduced, so that the polymer will contain repeating units derived from N-substituted or N, N-disubstituted aminoethylmethacrylates or similar monomers which can provide cationic sites.

The preferred fluoroacrylate monomer can be synthesized by the classic telomerization method, using free-radical initiation and tetrafluoroethylene as the starting material. The result of this synthesis is an essentially linear, saturated perfluorocarbon chain having an even number of carbon atoms (6, 8, 10, or 12). The telomerization process can be sufficiently well-controlled so that the 6-carbon, 10-carbon, and 12-carbon content of the telomer is very small (e.g. <about 20 mole-%, preferably <10 mole-%, of the product as to each length of fluorocarbon chain other than $C_8$), so that a major—or even predominant—amount of the 8-carbon telomer will be obtained. The telomer has an omega-halogen such as iodine; that is, the telomer can be substantially pure perfluorooctyl iodide. The $C_8F_{17}I$ compound can be converted to perfluorooctyl-ethanol, which is suitable for reaction with acrylic monomers such as acrylic acid or methacrylic acid. The result is a fluoroacrylic monomer of the formula III $$R_f—CH_2CH_2—O—(CO)—C(R)=CH_2 \quad \text{(III)},$$

Where $R_f$ has been defined previously (a $C_8$-rich fluorinated alkyl).

In its broadest aspect the term "acrylic monomer" can refer either to a co-reactant for the perfluoroalkyl-ethanol or a co-monomer for the fluoroacrylic monomer of formula III. Thus, the term "acrylic monomer" is intended to include monomers of formula IV:

$$R^2—O—(CO)—C(R^1)=CH_2 \quad \text{(IV)},$$

e.g. alkyl methacrylates, alkyl acrylates, 2-substituted ethyl acrylates or methacrylates, and the like.

For an advantageous balance of properties, monomer III and monomer IV are copolymerized, resulting in a polymer containing repeating units of the formulas I and II:

(I)

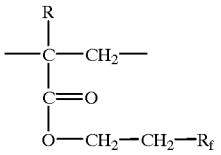

(II)

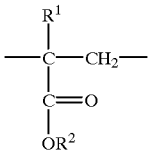

wherein $R_f$ is as defined previously,

R is hydrogen or a $C_1$–$C_4$-alkyl radical, e.g. methyl;

$R^1$ is the same as or different from R but is also hydrogen or a $C_1$–$C_4$-alkyl radical; and $R^2$ is hydrogen or a $C_1$–$C_8$-alkyl radical which is unsubstituted, or substituted by hydroxyl, $C_1$–$C_4$-alkoxy, etc., e.g. 2-hydroxyethylmethacrylate or 2-hydroxyethylacrylate.

Because the fluoroacrylate copolymer or heteropolymer (bipolymer, terpolymer, quaterpolymer, etc.) is the dispersed phase in an aqueous system (stated another way, it is the "oil" phase of an oil-in-water emulsion or dispersion), the fluoroacrylate copolymer is in the form of tiny particles, colloidal or nearly colloidal particles (e.g. 0.01 to 1, more preferably 0.01 to 0.1 $\mu$m) being normally preferred. The fluoroacrylate copolymer is prepared by emulsification polymerization in the presence of a minor amount (typically not more than 5 weight-%, more typically $\leqq 1$ weight-%, based on the weight of the resulting emulsion) of a surfactant system. The surfactant system serves more than one purpose. It helps protect against coagulation during emulsion polymerization; it helps to provide a stably dispersed copolymer after polymeriztion, and it assists the method of this invention by facilitating deposition onto the fiber of the fabric being after-treated.

Nonionic surfactants useful in this surfactant system generally contain one or more $C_2$–$C_3$-oxyalkylene units, and oxyethylene units preferably predominate. The oxyethylene chains can be obtained by interaction of mono- or polyhydroxy compounds with ethylene oxide. Sorbitol and its anhydrides (sorbitans) are typically employed as polyhydroxy compounds. Sorbitan esters also have surface-active properties.

Cationic surfactants generally contain a tertiary or quaternary nitrogen and preferably are quaternary ammonium salts or, less typically, amine salts. The N-substituted radicals can be aliphatic (e.g. alkyl groups) or oxyalkylated aliphatic groups. Cationic surfactants can be useful in the present invention, protonated- or quaternized-N compounds being typical of this class of surfactants, examples being primary to tertiary amine-organic or inorganic acid salts or a quaternary ammonium salt or a polyoxyethylene alkylamine salt. Mixed surfactant systems can be used. Of the cationic class, surfactants containing quaternary ammonium salts are preferred.

Amphoteric surfactants have a structure or structures which can be anionic or cationic, depending on the pH of the aqueous medium. For example, these surfactants can have both carboxyl/carboxylate or sulfonyl/sulfonate and amine/protonated amine groups or can be cyclic imido compounds with a urea structure such as fatty imidazolines.

An organic coalescent/stabilization liquid is also present in a minor amount (1 to 20 weight-%, preferably 1 to 10 weight-%) during the emulsion polymerization and remains in the resulting aqueous dispersion, dissolved in the aqueous medium. Preferred organic solvents used as coalescent/stabilization liquids are protic, e.g. aliphatic diols, triols, etc. Glycols such as dipropylene glycol and propylene glycol are particularly preferred.

Prior to dilution, the solids content of the preferred aqueous dispersion ranges from about 5 to about 40 weight-%, more preferably 5 to 15 weight-%. The dilution can take place in either of two ways. In the wash-tank embodiment of this invention, the aqueous dispersion is diluted very substantially through addition to the wash water. In the spray-application embodiment of this invention, the aqueous dispersion is preferably diluted before being introduced into the sprayer.

Excellent $R_f$-chain distributions are obtained with the aqueous dispersions of the REPEARL series, including REPEARL F-92 (for fluoroacrylate polymer melting points of about 70 to 80° C.) and REPEARL F-3700 (for much lower melting points), both products of Asahi Glass, available from Mitsubishi International Corporation, New York, N.Y. The F-3700 product, for example, contains 7 weight-% propylene glycol, 20 weight-% fluoroacrylate copolymer emulsion, and 73 weight-% water. The amount of surfactant system is no greater than about 1 weight-% and hence has no substantial effect upon the proportions given above.

The Treatment Medium

In the laundering embodiment of this invention, the treatment (and washing or rinsing) medium is obtained by adding a small amount of the aqueous dispersion to a tank of water large enough to accommodate immersion of the fabric item or items. One of the most effective uses of this treatment medium relates to restoring or enhancing the waterproofing of items of clothing.

In a commercial or home-laundering machine, the treatment medium is preferably formed during a very late stage of the total washing/rinsing cycle, in the absence of alkaline materials such as alkali metal salts of organic acids. A mild organic or inorganic acid ($pK_a$>2 or 3), preferably an organic carboxylic acid (typically called a "sour") can be added during this late stage of the complete cycle for greater effectiveness, e.g. to assist in the formation of cationic sites on the fluoroacrylate polymer and/or a surfactant in the surfactant component. Thus, the pH of the treatment medium is preferably <7, typically from about 4 to about 6, e.g. about 5.5. Aqueous media with a pH of up to 7.5 can be made operative, but are not preferred. Preferred carboxylic acid "sours" include citric acid, hydroxyacetic acid, and acetic acid. The preferred inorganic "sour" is hydrofluorosilicic acid.

The fluoropolymer need not exhaust onto the fibrous substrate to be effective. However, in a preferred embodiment, the fluoropolymer exhausts onto the fibrous substrate.

Equipment used in practicing this invention can be conventional home-use washers and dryers, commercial washers and dryers, and relatively crude hand-washing tanks available in field use. Gas, steam and electric-powered dryers for home use typically provide a heated environment having a maximum temperature of about 75° C., but commercial dryers can provide higher temperatures.

Washing machines include home-use machines, tunnel-washers and washer-extractors.

The treatment medium can be formed by using the fluoroacrylate polymer dispersion as a laundry additive introduced during a cycle of a washing machine containing a load of clothes or other fabric materials. A late cycle or operation of the washing machine is preferred to avoid alkaline conditions, and because it is desirable to retrieve the treated fabric articles without subjecting these articles to a rinsing step Alternatively, the dispersion can simply be added to hand-washing wash tank. In the latter approach, the load of clothes or other fibrous materials can be added to the tank after the treatment medium is in place. The acid or "sour" can be included in the fluoroacrylate dispersion and/or added to the treatment medium separately.

When an adequate heat source is unavailable or difficult to use, the wash load treated with the fluoroacrylate dispersion can be hung up to dry or otherwise dried at normal ambient temperatures, so long as the melting point of the fluoroacrylate polymer is low enough. Even when a clothes dryer is available, however, it can be advantageous to treat the fibrous material with a low-melting fluoroacrylate polymer, because the "delicate" setting of the dryer (<49° C.) can be as effective as the hotter settings.

In addition to containing the aqueous dispersion, the treatment medium can contain cleaning or laundering compositions, e.g. soap, an anionic detergent formulation, a bleaching agent, or a fabric softener. It is preferred, however, that alkaline detergent formulations and other alkaline materials be applied in an earlier cycle.

The dilution of the aqueous dispersion resulting from the addition to the large amount of water (e.g. the water in a wash tank) generally results in a washing and treating medium containing from about 0.25% to about 15% by weight of the aqueous dispersion. For military or other field applications, large concentrations of the dispersion in the treatment medium (e.g. 5 to 15% by weight) are desirable; the cost of the aqueous dispersion can be a minor concern, and a very high degree of waterproofing is the primary consideration. Under more conventional clothes-washing conditions, cost can be much more important. Good results are obtained with a wash tank containing about 1 to about 3% aqueous dispersion.

The resulting loading on the fabric is similar numerically to the concentrations of aqueous dispersion in the wash tank. Parts per hundred (phr) ratios provide a particularly convenient way to measure loading. In this context, "parts per hundred" refers to the parts by weight of aqueous dispersion added to the treatment medium in the wash tank with respect to 100 parts by weight of fabric material to be treated, e.g. 2 to 4 parts by weight of aqueous dispersion per hundred parts by weight of fabric (2 to 4 phr). Loadings of at least about 0.25 phr are preferred. Loadings in excess of 5 to 6 phr are generally too costly to be practical (at least in conventional laundering) and appear to provide no improvement over loadings of 3 to 4 phr or less. The most preferred loadings range from 1.0 to 3.5 phr.

In the case of the low-melting dispersed fluoroacrylate polymer, an alternative form of treatment medium is dispensable from a portable spray device such as a compressed-air sprayer or a conventional aerosol spray package provided with a spray valve and a propellant. For convenience, aerosol packages (e.g. cans) containing conventional non-CFC propellants (e.g volatile hydrocarbons, fluorinated $C_1$–$C_4$ alkanes, nitrogen, carbon dioxide, etc.) under ≦500 K Pa gauge pressure are desirable. Regardless of the type of portable sprayer used, an aerosol (extremely fine droplets of the aqueous dispersion mixed with a gas such as air) is desirable, whereas coarse sprays are not preferred. The fine droplets comprise particles of fluoroacrylate polymer surrounded by the aqueous dispersing medium. The polymer particles are far too small to clog conventional aerosol valves having orifices as large as 0.1 to 0.5 mm.

This alternative form of treatment medium preferably comprises an aqueous dispersion in which the sole fluoroacrylate polymer melts or softens in the range of about 20 to about 40° C. (e.g. REPEARL F-3700). Before spraying, the aqueous dispersion is diluted to a strength of about 2 to 15% by weight. The diluted aqueous dispersion can, for example, be stored in the tank of a sprayer or inside an aerosol package.

When this sprayable form of treatment medium is employed, the only conditions for drying and/or curing typically available are the environmental conditions, which can if necessary be outdoor conditions and would in that case be completely uncontrolled.

The Fabric Substrate To Be Treated

Fibrous items treated according to this invention can be woven or nonwoven. Suitable nonwoven materials include felts, air-laid batts, and similar materials prepared from staple fiber or microfibers. The fibers can be natural (e.g. cellulosic or proteinaceous) and/or synthetic (regenerated cellulose, chemically modified cellulose, or wholly synthetic organic polymer fibers made from polymers such as the polyamides, polyesters, polyolefins, partially hydrolyzed polyvinyl acetates, other vinyl polymers, etc.). Typical fibers of materials treated in accordance with this invention include polyester, cotton, nylon, rayon, silk, spandex, wool, and various blends of these fibers. Synthetic fibers can have modest inherent fluid-repellent (typically water-repellent) properties but are generally not sufficiently fluid-repellant to avoid being permanently stained by, for example, various foods, bodily fluids, strongly-colored materials such as inks or paints, oily or greasy materials, and in-the-field soils (e.g. from earth or vegetation). The inherent waterproofing effects of such synthetic fibers are insufficient to protect a wearer against becoming rain-soaked.

The methods of this invention improve resistance to such severe stains and rain-soaking by imparting (or restoring) fluid repellency and are particularly useful with two classes of materials: first, garments or protective gear frequently exposed to mildew, rain-soaking, or heavy stains from bodily fluids or foods, such as surgical gowns, surgical drapes, surgical pack wraps, personal protection or isolation gowns, laundry bags, cubicle curtains, uniforms or costumes (especially banquet jackets), table cloths, butcher's coats, laboratory or food service aprons, and garments for field use such as shirts, coats or jackets, trousers, and hats, especially all-weather and military garments. The first class of items includes fluid-proof surgical gowns containing barrier films. Most items in this class of materials are generally subject to very frequent heavy-duty laundering or other forms of cleaning, and an objective of this invention is to provide fluid-repellent properties which persist throughout the useful life of the item. A typical item in this class of materials is laundered to remove stains at least 50 or 100 times before it is too deteriorated, worn, or damaged to be useful any longer. Surgical gowns, for example, should survive 100 to 150 washings before being discarded; otherwise, it may make more economic sense to use disposable gowns.

The other class of materials includes fully-manufactured items which cannot be laundered in the usual way, due to their bulkiness or weight, e.g. upholstered furniture, tents, and awnings.

The principle and practice of this invention is illustrated by the following non-limiting Examples.

In these Examples, various tests for the efficacy of the treatments were used.

The Water Repellency Test (Aqueous Liquid "Hold Out" Ability)

This test, 3M Water Repellency Test II, also known as the "drop test" rates the ability of the treated fabric to "hold out"

water/alcohol mixtures containing up to 100% alcohol. A test liquid is "held out" when the surface tension of at least two of three test drops retain the coherency of the drops for at least 10 seconds. Coherent drops assume a spherical or hemispherical shape rather than being absorbed into the fabric. The test is described in detail in copending application Ser. No. 09/160,019. The rating is on a scale of 1 to 10, based on the composition of the test liquid which varies in accordance with the following table

| Test Liquid | Percent Composition of Test Liquid | Surf. Tension Dynes/cm (20° C.) |
|---|---|---|
| W | 100 Water | 72.8 |
| 1 | 90/10 Water/Isopropyl Alcohol | 39.0 |
| 2 | 80/20 Water/Isopropyl Alcohol | 32.0 |
| 3 | 70/30 Water/Isopropyl Alcohol | 28.3 |
| 4 | 60/40 Water/Isopropyl Alcohol | 26.6 |
| 5 | 50/50 Water/Isopropyl Alcohol | 25.0 |
| 6 | 40/60 Water/Isopropyl Alcohol | 24.3 |
| 7 | 30/70 Water/Isopropyl Alcohol | 23.7 |
| 8 | 20/80 Water/Isopropyl Alcohol | 23.3 |
| 9 | 10/90 Water/Isopropyl Alcohol | 22.4 |
| 10 | 100 Isopropyl Alcohol | 21.7 |

The test sample on which the solutions are applied is 20×20 cm (8×8 inch). The test procedure is as follows.

1. Place the test sample on a flat, horizontal surface.

2. Using a dropper or pipette, gently place 3 small drops, approximately 5 mm (3/16 inch) in diameter, of the test liquid in two or three different areas on the test sample. Do not touch the test sample with the dropper tip.

3. Allow the drops to stand undisturbed for 10 seconds.

When this evaluation is being done on an open weave or "thin" fabric, the water repellency test must be conducted on at least two layers of the fabric; otherwise the test liquid may wet the underlying surface, not the actual test fabric and cause confusion in the reading of results.

The results are evaluated and the water repellency rating is calculated using the following procedure.

1. If after 10 seconds, two of the three drops are still visible as spherical to hemispherical, the substrate passes the test.

2. Substrates are rated as pass or fail for the appropriate test liquid (W through 10). The numerical rating given a particular substrate is the highest numbered test liquid which remains visible.

The Spray Test—AATCC Test Method 22-1989

The Spray Test measures fabric resistance to wetting by water. According to the test procedure, a specified amount of water is sprayed over the fabric's surface, and the pattern of wetting indicates the fabric's ability to repel water. The lowest rating is 0 (poor resistance) and the highest is 100 (excellent resistance).

The Oil Repellency Test

Oil repellency is determined by reference to AATCC Test Method 118-1992 Oil Repellency: Hydrocarbon Resistance Test. This test determines a fabric's resistance to wetting by oily materials. A variety of oils with different surface tensions are introduced to the fabric. The oily liquid with the highest surface tension that is held out by the fabric determines the test rating.

Stated another way, the higher the number attained in this test, the better the fabric's ability to hold out oily substances.

The Suter Test

The Suter rating is determined by reference to AATCC Test Method 127-1989 Water Resistance: Hydrostatic Pressure Test. Suter rating data are available only for the first set of "wash process" Examples.

Treatment Agents Tested

In the following Examples, fabric items or articles were treated in various ways using the following agents:

I. The "B" (extender-containing, higher-melting) Product

This agent is PROTEX 2000-B fluid repellent, a trademark of M&M Technologies, Inc., Wilmington, Del., U.S.A. for a dispersion containing

| | |
|---|---|
| Perfluoroacrylate copolymer (similar to those of this invention) | 8* weight-% |
| Dipropylene glycol | 5* weight-% |
| Water (dispersing medium) | 76* weight-% |
| Paraffin and hydrocarbon waxes (hydrophobic extender) | 11* weight-% |
| Surfactant system | <1 weight-% |

*These percentages are actually very slightly smaller in order to allow for the surfactant.

The perfluoroacrylate copolymer of the B product has a melting point of 70 to 80° C., as in the present invention. However, because the B Product contained an extender, it had the same problems as prior art extender-containing products.

II. The "C" (extender-free, higher-melting) Product (of application Ser. No. 09/160,019)

This agent is PROTEX 2000-C fluid repellent, a trademark of M&M Technologies, Inc., Wilmington, Del., U.S.A. for a dispersion containing

| | |
|---|---|
| Perfluoroacrylate copolymer (polymer of REPEARL F-92) | 10* weight-% |
| Dipropylene glycol | 6* weight-% |
| Water (dispersing medium) | 84* weight-% |
| Surfactant system | <1 weight-% |

*These percentages are actually very slightly smaller in order to allow for the surfactant.

The perfluoroacrylate copolymer of the C product has a melting point of 70 to 80° C.

III. The "AD" (extender-free, lower-melting) Product

This agent is PROTEX 2000 fluid repellent-AD, a trademark of M&M Technologies, Inc., Wilmington, Del., U.S.A. for a dispersion containing

| | |
|---|---|
| Perfluoroacrylate copolymer (polymer of REPEARL F-3700) | 8* weight-% |
| Propylene glycol | 3* weight-% |
| Water (dispersing medium) | 89* weight-% |
| Surfactant system | <1 weight-% |

*These percentages are actually very slightly smaller in order to allow for the surfactant system.

The perfluoroacrylate copolymer of the AD product has a melting point of 20 to 30° C.

"Wash Process" Examples (Examples 1 to 5)

In this series of Examples, the term "typical wash process" is used to describe a commercial laudering process having the following sequence of steps.

| | OPERATION | TIME MIN. | TEMP ° F. | LEVEL | SUPPLY |
|---|---|---|---|---|---|
| 1 | Flush | 2 | 100° | 12" | — |
| 2 | Break | 8 | 160° | 6" | Detergent |
| 3 | Flush | 2 | Hot and cold | 12" | — |
| 4 | Rinse | 2 | Hot and cold | 12" | — |
| 5 | Rinse | 2 | Hot and cold | 12" | — |
| 6 | Rinse | 2 | Hot and cold | 12" | — |
| 7 | Sour (optional) | 5 | 90° | 8" | Sour |
| 8 | Repellent | 8–10 | 110° | 8" | 1% by weight of fabric of the C Product |
| 9 | Extract | 6–8 | — | — | — |

EXAMPLE I

New 50/50% polycotton fabric was washed using the typical wash process. To the last 26 cycle an amount of the C Product equivalent to 1% by weight of the fabric being washed was 27 added. Cycle time was 8 minutes. The fabric was removed and dried in a commercial dryer at 180° F. The fabric with no treatment had a water repellency rating of 0, an oil repellency rating of 0, and a Suter rating of 0. After treatment, the water repellency rating was 5, the oil repellency rating was 4, and the Suter rating was 20 cm.

EXAMPLE 2

The treated fabric in Example 1 was washed and treated again using the same wash method. After the second treatment, the water repellency rating was 10, the oil repellency rating was 6, and the Suter rating was 30 cm.

EXAMPLE 3

New polyester gowns were washed as indicated in Example 1 for 50 and 100 times. The results are set forth below.

| Item Treated | Water Repellency | Oil Repellency | Suter Test |
|---|---|---|---|
| New polyester, single ply gown | 6 | 5 | 45 |
| Above gown washed & treated 50 times | 7 | 6 | 51 |
| Above gown washed & treated an additional 50 times, 100 times total | 8 | 6 | 60 |

EXAMPLE 4

Using the typical wash procedure without addition of any of the treatment agents described above (without the B, C, or AD Products), a 100% polyester, double-ply gown was washed 10 times. The gown was then washed and treated at the 1% level as in example 1. The results are shown below.

| Item Treated | Water Repellency | Oil Repellency | Suter Test |
|---|---|---|---|
| New polyester gown washed 10 times using no treatment | 2 | 0 | 70 |
| Above gown treated once | 9 | 5+ | 81 |

EXAMPLE 5

Using the wash formula of Example 1, a selection of various fabrics was treated and evaluated. The results were as follows.

| Items Washed | Initial Water Repellency | Number of Times Washed and Treated 1 | 2 | 3 | 4 | 5 |
|---|---|---|---|---|---|---|
| New 50/50% polycotton fabric | 0 | 5 | 10 | 10 | 10 | 10 |
| New 10% polyester fabric | 0 | 7 | 10 | 10 | 10 | 10 |
| New T-180 fabric (50/50% polycotton surgical gown fabric) | 6 | 7 | 8 | 8 | 9 | 9 |
| New Isolation bag-100% polyester | 2 | 7 | 10 | 10 | 10 | 10 |
| New Angelica ASEP gown-100% polyester | 7 | 7 | 8 | 8 | 8 | 9 |
| Used Angelica ASEP gown-100% polyester | 5 | 7 | 7 | 8 | 8 | 8 |
| Used 50/50% polyester/cotton gown | 5 | 7 | 9 | 9 | 9 | 9 |

EXAMPLE 6

Comparison, With and Without Extender

In this Example, the B (extender-containing) Product was compared with the C (extender free) Product. Gowns were treated as in Example 1 using the B Product in one test, the C Product in a second test, and no treatment in a third test. The Suter rating was measured for each test. The results are set forth below and demonstrate the surprising advantages of the present invention.

| No. of washings | 1–10 | 11–20 | 21–30 | 31–40 | 41–50 | 51–60 | 61–70 |
|---|---|---|---|---|---|---|---|
| B Product | 90 cm | 83 | 84 | 77 | 80 | 78 | 82 |
| C Product | 103 cm | 104 | 104 | 104 | 95 | 90 | 85 |
| No treatment | 80 cm | 70 | 61 | 57 | 44 | 40 | 30 |

HIGH AND LOW TEMPERATURE DRYING EXAMPLES (EXAMPLES 7 TO 9)

The purpose of this set of Examples is to demonstrate that fabrics treated with the AD Product and then dried at room temperature perform approximately as well, in these three tests, as fabric which has been treated with the C Product—or the AD Product—and then dried ("cured") with heat at a temperature above 55° C. (e.g. 60° C.).

To illustrate this performance more clearly, in Part C-H of each Example, treatment was with the C Product, followed by drying under heat. In Part AD-H of each Example, treatment was with the AD Product, also followed by drying under heat. In Part AD-RT of each Example, the samples treated with the AD Product were dried at room temperature and were given no heat treatment.

EXAMPLE 7

Water Repellency Test

Part C-H: In this Part of Example 1, cotton/polyester ("C/PE") and 100% polyester ("PE") fabric samples with negligible waterproofing and oil-repellent properties were immersed in a bath or tank containing a large volume of water and the C Product. The C Product was added to the water in the tank in five different quantities to provide a series of percentages of emulsion, based on the weight of the liquid in the tank, ranging form 0.25% to 3%. After removal from the tank, the samples were then dried at a standard dryer setting (at least about 60° C.) to "cure" the deposits of fluoroacrylate copolymer emulsoid particles on the fabric.

Three tests were carried out at each percentage of emulsion. The pH and the density of the medium were varied slightly from test to test but appeared to have no significant effect upon the results (pH ranged from 2.82 to 3, and density ranged from 1.0 to 1.026).

Each numerical rating given in the following Table (Table I) reflects the range of values obtained in the three tests.

Part AD-H: In this Part of Example 7, cotton/polyester ("CIPE") and 100% polyester ("PE") fabric samples with negligible waterproofing and oil-repellent properties were immersed in a bath or tank containing a large volume of water and the AD Product. The AD Product was added in five different amounts to provide another series of percentages of emulsion, based on the weight of the liquid in the tank, ranging form 0.25% to 3%. The immersed samples were dried at a standard dryer setting (≧60° C.).

Two tests were carried out at each percentage of emulsion. Each numerical rating given in the following Table (Table I) reflects the range of values obtained in the these two tests. In the event that the two tests differed by more than one rating unit, e.g. if test no. 1 were to give a rating of 5 and test no. 2 were to give a rating of 7, the range of values would be expressed as "5 to 7."

Part AD-RT: In this Part of Example 7, cotton/polyester ("C/PE") and 100% polyester ("PE") fabric samples with negligible waterproofing and oil-repellent properties were immersed in a bath or tank containing a large volume of water and the AD Product, but this time the fabric samples were not dried under heat; they were permitted to dry at room temperature. The AD Product was added as before to provide concentrations of emulsion ranging form 0.25% to 3%.

Two tests were carried out at each percentage. Each numerical rating given in the following Table (Table I) reflects the range of values obtained in the these two tests. In the event that the two tests differed by more than one rating unit, the reporting procedure described in Part AD-H was employed.

TABLE I

WATER REPELLENCY TEST RESULTS (Example 7)

| Applied Amount* (%) | Fabric | Ex. 7, "C-H" (3 Samples) | Ex. 7, "AD-H" (2 Samples) | Ex. 7, "AD-RT" (No Heat, 2 Samples) |
|---|---|---|---|---|
| 0.25 | C/PE | 3 to 4 | 3 to 4 | 3 to 4 |
| 0.50 | C/PE | 4 to 5 | 5 | 5 |
| 1.0 | C/PE | 7 | 6 to 7 | 7 |
| 1.5 | C/PE | 8 to 9 | 7 to 9 | 9 |
| 3 | C/PE | 9 to 10 | 9 to 10 | 10 |
| 0.25 | PE | 6 | 6 to 7 | 6 to 7 |
| .50 | PE | 8 | 8 to 9 | 7 to 8 |
| 1.0 | PE | 9 | 10 | 9 to 10 |
| 1.5 | PE | 10 | 10 | 10 |
| 3 | PE | 10 | 10 | 10 |

EXAMPLE 8

Spray Test Results

Part C-H: In this Part of Example 8, cotton/polyester ("C/PE") and 100% polyester ("PE") fabric samples with negligible waterproofing and oil-repellent properties were given the Spray Test. The fabric samples were first treated as in Example 7, Part C-H. The emulsion levels in the treatment tank were the same as in Example 7, i.e. based on the weight of the liquid in the tank, these levels ranged form 0.25% to 3%. The drying temperature was standard, as in Part C-H of Example 7.

Three tests were carried out at each percentage of emulsion. Each numerical rating given in the following Table (Table II) reflects the range of values obtained in the three tests.

Part AD-H: In this Part of Example 8, cotton/polyester ("C/PE") and 100% polyester ("PE") fabric samples with negligible waterproofing and oil-repellent properties were immersed in a bath or tank containing a large volume of water and the AD Product. The AD Product was added, as before, in increasing increments of concentration in the treatment medium in the tank (concentrations ranging form 0.25% to 3%). The drying temperature was determined by the standard dryer setting, as in Parts C-H and AD-H of Example 7.

Two tests were carried out at each percentage of emulsion. Each numerical rating given in the following Table (Table II) reflects the range of values obtained in the these two tests.

Part AD-RT: In this Part of Example 8, cotton/polyester ("C/PE") and 100% polyester ("PE") fabric samples with negligible waterproofing and oil-repellent properties were immersed in a bath or tank containing a large volume of water and the AD Product, but this time the fabric samples were not dried under heat; they were permitted to dry at room temperature as in Part AD-RT of Example 1. The AD Product was added to the treatment medium in increments, as before (0.25% to 3%).

Two tests were carried out at each percentage. Each numerical rating given in the following Table (Table II) reflects the range of values obtained in the these two tests.

TABLE II

SPRAY TEST RESULTS (Example 8)

| Applied Amount** (%) | Fabric | Ex. 9, Part C-H (3 Samples) | Ex. 9, Part AD-H (2 Samples) | Ex. 9, Part AD-RT (No Heat, 2 Samples) |
|---|---|---|---|---|
| 0.25 | C/FE | 50 to 80 | 0 to 50 | 0 |
| 0.50 | C/PE | 70 to 80 | 50 to 70 | 50 |
| 1.0 | C/PE | 80 to 90 | 70 to 80 | 50 |
| 1.5 | C/PE | 90 to 100 | 90 | 70 |
| 3 | C/PE | 100 | 100 | 70 |
| 0.25 | PE | 80 to 90 | 70 | 50 |
| 0.50 | PE | 90 to 100 | 80 | 50 to 70 |
| 1.0 | PE | 100 | 90 | 70 to 80 |
| 1.5 | PE | 100 | 100 | 70 to 80 |
| 3 | PE | 100 | 100 | 80 to 90 |

**See Table I.

TABLE III

OIL REPELLENCY TEST RESULTS (Example 3)

| Applied Amount*** (%) | Fabric | Ex. 8, Part A (3 Samples) | Ex. 8, Part B (2 Samples) | Ex. 8, Part C (No Heat, 2 Samples) |
|---|---|---|---|---|
| 0.25 | C/FE | 2 to 3 | 2 | 2 to 3 |
| 0.50 | C/PE | 3 to 4 | 3 | 3 |
| 1.0 | C/PE | 4 to 6 | 4 to 5 | 4 to 5 |
| 1.5 | C/PE | 5 to 6 | 5 | 6 |
| 3 | C/PE | 6 to 8 | 6 | 7 to 8 |
| 0.25 | PE | 5 | 5 | 5 |
| 0.50 | PE | 6 to 7 | 6 | 6 |
| 1.0 | PE | 7 to 8 | 7 | 6 to 7 |
| 1.5 | PE | 7 to 8 | 7 to 8 | 7 to 8 |
| 3 | PE | 8 | 8 | 8 |

***See Table I.

EXAMPLE 9

Oil Repellency Test

Part C-H: In this Part of Example 9, cotton/polyester ("C/PE") and 100% polyester ("PE") fabric samples with negligible waterproofing and oil-repellent properties were given the Oil Repellency Test, AATCC Test Method 118-1992. The fabric samples were first treated as in Example 7, Part C-H. The emulsion levels in the treatment tank were the same as in Example 7, i.e. based on the weight of the liquid in the tank, these levels ranged form 0.25% to 3%. The drying temperature was standard, as in Part C-H of Example 7.

Three tests were carried out at each percentage of emulsion. Each numerical rating given in the following Table (Table III) reflects the range of values obtained in the three tests.

Part AD-H: In this Part of Example 8, cotton/polyester ("C/PE") and 100% polyester ("PE") fabric samples with negligible waterproofing and oil-repellent properties were immersed in a bath or tank containing a large volume of water and the AD Product; the five different levels of emulsion were the same as in Examples 7 and 8. The drying temperature was determined by the standard dryer setting, as in Part AD-H of Examples 7 and 8.

Two tests were carried out at each percentage of emulsion in the tank. Each numerical rating given in the following Table (Table III) reflects the range of values obtained in the these two tests.

Part AD-RT: In this Part of Example 8, cotton/polyester ("CIPE") and 100% polyester ("PE") fabric samples with negligible waterproofing and oil-repellent properties were immersed in a bath or tank containing a large volume of water and the AD Product, but this time the fabric samples were not dried under heat; they were permitted to dry at room temperature. The AD Product levels were the same as in Examples 7 and 8 and Example 9, Parts C-H and AD-H.

Two tests were carried out at each percentage of emulsion. Each numerical rating given in the following Table (Table II) reflects the range of values obtained in the these two tests.

What is claimed is:

1. A method for restoring or providing the waterproofing of a fully manufactured article comprising fabric, said method comprising the steps of:

A. applying to the fabric of said article a diluted aqueous dispersion containing, dispersed therein as essentially the sole waterproofing component, a particulate fluoropolymer component comprising a fluoroacrylate copolymer having repeating units of the formulas I and II (I)

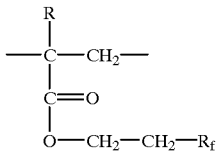

(II)

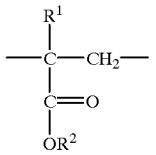

wherein $R_f$ represents the fluorinated alkyl radicals, the major amount of which have 8 carbon atoms;

R is hydrogen or a $C_1$–$C_4$-alkyl radical;

$R^1$ is the same as or different from R but is also hydrogen or a $C_1$–$C_4$-alkyl radical; and $R^2$ is hydrogen or a $C_1$–$C_8$-alkyl radical which is unsubstituted or substituted;

said fluoroacrylate copolymer having a melting or softening point in the range of about 20 to about 100° C. and being essentially free of —$SO_2$— and urethane groups, said aqueous dispersion containing a minor amount of surfactant component, for dispersing said fluoropolymer and maintaining said fluoropolymer in a dispersed state and for assisting the fluoropolymer in depositing on the fabric, and a minor amount of polar organic liquid dissolved therein, B. drying the thus-treated fabric at a temperature in the range of 20 to 100° C., until the waterproofing of said fabric has been restored, enhanced, or provided, without further drying at any temperature higher than 100° C.

2. A method according to claim 1, wherein $R^2$ is a $C_1$–$C_4$-alkyl radical which is unsubstituted or is substituted with a hydroxyl group.

3. A method according to claim 1, wherein said polar organic liquid is a protic compound and is present in said aqueous dispersion, prior to dilution, in an amount ranging from 1 to 10% by weight.

4. A method according to claim 3, wherein said aqueous dispersion, prior to dilution, consists essentially of:

a. 50 to 90% by weight of a continuous aqueous phase, b. 2 to 10% by weight of the protic organic liquid dissolved in said continuous aqueous phase, c. dispersed in said continuous aqueous phase, 5 to 40% by weight of a dispersed phase consisting essentially of a single said particulate fluoroacrylate copolymer, and d. to stabilize said dispersion, said surfactant component.

5. A method according to claim 1, wherein said particulate fluoroacrylate polymer has been obtained by co-polymerizing a monomer of the formula $$R_f—CH_2CH_2—O—(CO)—C(R)=CH_2 \quad (III)$$

and a monomer of the formula $$R^2—O—(CO)—C(R^1)=CH_2 \quad (IV)$$

in the presence of said polar organic liquid as coalescent/stabilization solvent and said surfactant component, where R, $R^1$, $R^2$, and $R_f$ are as defined previously.

6. A method according to claim 5, wherein said $R_f$ is a linear perfluorinated radical that has been obtained by free-radical telomerization of tetrafluoroethylene and comprises perfluorooctyl radicals, the amount of fluorinated alkyl groups having 6, 10, or 12 carbons being less than about 10% by weight of the radical $R_f$.

7. A method according to claim 1, wherein said drying step is carried out under normal ambient conditions of temperature and pressure, and wherein said softening or melting point is in the range of about 20 to about 40° C.

8. A method according to claim 1, wherein the fabric of said article comprising fabric has been pre-treated with a fluorochemical during the manufacture of said article, and wherein said article has lost water repellency properties through cleaning or use.

9. A method according to claim 1, wherein the article comprising fabric is immersed in an aqueous medium, and a minor amount of said aqueous dispersion, relative to the aqueous medium, is introduced into said aqueous medium before or after said article is immersed.

10. A method according to claim 9, wherein the article comprising fabric is treated by introducing the article into the wash tank of a washing machine during the last cycle of operation of the washing machine, and retrieving the resulting treated article from the wash tank, and wherein said melting or softening point is in the range of 55 to 100° C.

11. A method according to claim 9, wherein said fluoroacrylate copolymer is exhausted onto the fabric of said article.

12. A method according to claim 1, comprising the steps of:

A. spraying said manufactured article with an aerosol, said aerosol comprising droplets formed from the aqueous dispersion, said fluoroacrylate copolymer of said aqueous dispersion having a melting or softening point in the range of about 20 to about 40° C., B. drying the thus-treated fabric under normal ambient conditions of temperature and pressure, until the waterproofing of the fabric is restored, provided or enhanced, without further drying.

13. A method according to claim 12, wherein said aqueous dispersion, prior to spraying, has been diluted to a concentration of said dispersion of about 2 to about 15% by weight of the liquid to be sprayed as an aerosol.

* * * * *